US009249370B2

(12) United States Patent
Küpper et al.

(10) Patent No.: US 9,249,370 B2
(45) **Date of Patent: *Feb. 2, 2016**

(54) USE OF O/W EMULSIONS FOR CHAIN LUBRICATION

(71) Applicant: Ecolab USA Inc., St. Paul, MN (US)

(72) Inventors: Stefan Küpper, Langefeld (DE); Christina Kohlstedde, Bochum (DE); Michael Schneider, Grevenbroich (DE)

(73) Assignee: Ecolab USA Inc., St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/277,259

(22) Filed: May 14, 2014

(65) Prior Publication Data

US 2014/0336091 A1 Nov. 13, 2014

Related U.S. Application Data

(63) Continuation of application No. 11/870,266, filed on Oct. 10, 2007, now Pat. No. 8,759,263, which is a continuation of application No. 10/490,569, filed as application No. PCT/EP02/10157 on Sep. 11, 2002, now Pat. No. 7,297,666.

(30) Foreign Application Priority Data

Sep. 20, 2001 (DE) ..... 101 46 264

(51) Int. Cl.

| | |
|---|---|
| ***C10M 173/00*** | (2006.01) |
| ***C10M 129/74*** | (2006.01) |
| ***C10M 129/70*** | (2006.01) |
| ***C10M 173/02*** | (2006.01) |
| ***C10M 111/04*** | (2006.01) |

(52) U.S. Cl.

CPC ..... *C10M 111/04* (2013.01); *C10M 173/025* (2013.01); *C10M 2205/18* (2013.01); *C10M 2207/021* (2013.01); *C10M 2207/022* (2013.01); *C10M 2207/046* (2013.01); *C10M 2207/122* (2013.01); *C10M 2207/281* (2013.01); *C10M 2207/283* (2013.01); *C10M 2207/289* (2013.01); *C10M 2207/2815* (2013.01); *C10M 2207/40* (2013.01); *C10M 2209/104* (2013.01); *C10M 2209/108* (2013.01); *C10M 2209/1033* (2013.01); *C10M 2215/04* (2013.01); *C10M 2215/042* (2013.01); *C10M 2229/0465* (2013.01); *C10N 2240/52* (2013.01); *C10N 2250/022* (2013.01); *C10N 2260/06* (2013.01); *C10N 2270/02* (2013.01)

(58) Field of Classification Search

CPC ..... C10M 111/04; C10M 173/025; C10M 2205/18; C10M 2207/021; C10M 2207/022; C10M 2207/046; C10M 2207/122; C10M 2207/281; C10M 2207/2815; C10M 2207/283; C10M 2207/289; C10M 2207/40; C10M 2209/1033; C10M 2209/104; C10M 2209/108; C10M 2215/04; C10M 2215/042; C10M 2229/0465; C10N 2240/52; C10N 2250/02; C10N 2260/06; C10N 2270/02

USPC ..... 508/451, 463, 506

See application file for complete search history.

(56) References Cited

U.S. PATENT DOCUMENTS

| | | | | |
|---|---|---|---|---|
| 4,420,578 | A | 12/1983 | Hagens et al. | |
| 5,230,730 | A * | 7/1993 | Speckmann et al. | 106/14.13 |
| 5,352,376 | A | 10/1994 | Gutzmann | |
| 5,559,087 | A | 9/1996 | Halsrud et al. | |
| 5,660,865 | A | 8/1997 | Pedersen et al. | |
| 5,900,392 | A * | 5/1999 | Bernhard | 508/154 |
| 5,925,601 | A | 7/1999 | McSherry et al. | |
| 5,938,327 | A * | 8/1999 | Benskin et al. | 366/137.1 |
| 6,214,777 | B1 | 4/2001 | Li et al. | |
| 6,250,458 | B1 | 6/2001 | Shibayama et al. | |
| 6,423,303 | B1 * | 7/2002 | Ryklin et al. | 424/60 |
| 6,495,494 | B1 | 12/2002 | Li et al. | |
| 6,509,302 | B2 | 1/2003 | Li et al. | |
| 6,537,562 | B1 * | 3/2003 | Boettcher et al. | 424/401 |
| 7,297,666 | B2 * | 11/2007 | Kupper et al. | 508/451 |
| 8,759,263 | B2 * | 6/2014 | Kupper et al. | 508/463 |
| 2002/0051750 | A1 * | 5/2002 | Schutt et al. | 424/9.52 |
| 2002/0051850 | A1 | 5/2002 | Bennett et al. | |

FOREIGN PATENT DOCUMENTS

| | | | | |
|---|---|---|---|---|
| DE | 4140562 | | 6/1993 | |
| DE | 4206506 | | 9/1993 | |
| DE | 19703087 | | 7/1998 | |
| DE | 19751744 | | 5/1999 | |
| DE | 19751744 | A1 * | 5/1999 | C10M 173/02 |
| DE | 19942535 | | 3/2001 | |
| EP | 0345586 | | 12/1989 | |
| EP | 1197544 | | 4/2002 | |
| WO | WO 98/32413 | A1 | 7/1998 | |

(Continued)

OTHER PUBLICATIONS

Gilbert, Peter, "*Conveyor Lubrication in Dairies, Breweries and Beverage Plants*", Klensan (Pty) Ltd., S.A. Food Review—Dec. 1981/Jan. 1982, pp. 27-28, 2 pages.

Gorton, Hugh J. Ph.D. and Taylour, Jim M. P.D. C Chem, "*The Development of New Conveyor Lubricant Technology*", MBAA Technical Quarterly, vol. 30, pp. 18-22, 1993, 5 pages.

(Continued)

*Primary Examiner* — James Goloboy

(74) *Attorney, Agent, or Firm* — Merchant & Gould P.C.

(57) ABSTRACT

The invention relates to the use of an O/W emulsion, in particular a PIT emulsion, for lubricating conveyor belt systems in food industries as well as a lubricant concentrate based on an O/W emulsion, in particular a PIT emulsion, of wax esters.

19 Claims, No Drawings

(56) References Cited

FOREIGN PATENT DOCUMENTS

| | | | |
|---|---|---|---|
| WO | WO 9832413 | A1 * | 7/1998 |
| WO | WO 01/12759 | | 2/2001 |
| WO | WO 2006/017503 | | 2/2006 |

OTHER PUBLICATIONS

Henkel Ecolab, "*Conveyor Lubrication*", 27 Food Ireland, 1 page.
Packaging Hygiene, "Maintaining hygiene on filler line conveyor track", 2 pages.

* cited by examiner

USE OF O/W EMULSIONS FOR CHAIN LUBRICATION

CROSS REFERENCE TO RELATED APPLICATION

This application is a continuation of U.S. application Ser. No. 11/870,266 filed Oct. 10, 2007, and issued as U.S. Pat. No. 8,759,263 on Jun. 24, 2014, which is a continuation of U.S. patent application Ser. No. 10/490,569 filed May 12, 2004, and issued as U.S. Pat. No. 7,297,666 on Nov. 20, 2007, which is a 371 of PCT/EP02/10157 filed Sep. 11, 2002, the entire disclosures of which are incorporated herein by reference in their entirety.

FIELD OF THE INVENTION

The present invention concerns the use of an O/W emulsion, in particular a PIT emulsion, for the lubrication of conveyor belt systems in food processing plants and a lubricant concentrate based on wax esters.

DETAILED DESCRIPTION

In the food industry, in particular in beverage plants, the containers that are to be filled in the filling plants are transported by means of conveyors in a wide variety of designs and materials, for example by means of apron conveyors or chain-type arrangements, which will be referred to in general terms below as conveyor chains. The conveyors link the various optional treatment stages of the filling process, such as e.g. unpacker, bottle washing machine, filler, sealer, labeler, packer, etc. The containers can come in a wide variety of forms, in particular glass and plastic bottles, cans, jars, casks, drinks containers (KEG), paper and cardboard containers. To ensure that the operation proceeds smoothly, the conveyor chains must be lubricated by suitable means such that excessive friction on the containers is avoided. Dilute aqueous solutions containing suitable antifriction agents are conventionally used for lubrication. The conveyor chains are brought into contact with the aqueous solutions by immersion or by spraying, for example, and this is then referred to as splash lubrication plant or automatic belt lubrication system or central chain lubrication system.

The chain lubricants that have been used until now as lubricating agents are mostly based on fatty acids in the form of their water-soluble alkali or alkanolamine salts or on fatty amines, preferably in the form of their organic or inorganic salts.

Whilst both classes of substances can be used without any problems in splash lubrication, they display a series of disadvantages in the central chain lubrication systems that are conventionally used today. Thus, DE-A-23 13 330 describes soap-based lubricants containing aqueous blends of C16-C18 fatty acid salts and surface-active substances. Such soap-based lubricants display the following disadvantages:

1. A reaction occurs with the water hardness, in other words the alkaline earth ions and other water constituents, forming poorly soluble metal soaps know as primary alkaline earth soaps.

2. A reaction occurs between these soap-based lubricants and carbon dioxide dissolved in water or in the product to be filled.

3. The working solution thus formed is always promoting germ life.

4. If hard water is used, ion exchangers are needed to soften the water, representing an additional source of germs (and therefore rarely encountered in practice), or the use of products having a high content of complexing agents is required, which in turn is ecologically critical.

5. Increased foaming occurs, which can in particular cause problems at the bottle inspector (automatic bottle control) and leads to greater wetting of the transport containers.

6. Most of these products contain solvents.

7. The cleaning effect of these products is poor, which means that a separate cleaning stage is necessary.

8. The performance of such soap-based lubricant formulations is dependent on their pH.

9. Soap-based lubricant formulations also display a water temperature dependency.

10. Soap-based lubricants have only a short storage life, particularly at low temperatures.

11. EDTA (ethylenediamine tetraacetate), which is contained in many products, is known to be only poorly biodegradable.

12. Such soap-based lubricant formulations are not suitable for all transport items made of plastics, since in many cases the transport item can suffer stress corrosion cracking when these agents are used.

In addition to soap-based lubricants, those based on fatty amines are principally used. Thus, DE-A-36 31 953 describes a process for the lubrication of chain-type bottle conveyor belts in beverage filling plants, particularly in breweries, and for cleaning the belts with a liquid cleaning agent, which process is characterized in that the chain-type bottle conveyor belts are lubricated with belt lubricants based on neutralized primary fatty amines, which preferably have 12 to 18 C atoms and include an unsaturated content of more than 10%.

Fatty amine derivatives having the formulae

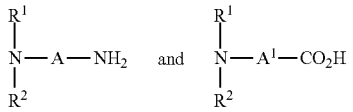

are known from EP-A-0 372 628 as lubricants, wherein $R^1$ represents a saturated or unsaturated, branched or linear alkyl group with 8 to 22 C atoms;

$R^2$ represents hydrogen, an alkyl or hydroxyalkyl group with 1 to 4 C atoms or $-A-NH_2$;

A represents a linear or branched alkylene group with 1 to 8 C atoms; and $A^1$ represents a linear or branched alkylene group with 2 to 4 C atoms.

Furthermore, lubricants based on N-alkylated fatty amine derivatives containing at least one secondary and/or tertiary amine are known from DE-A-39 05 548.

From DE-A-42 06 506 are known:

Soap-free lubricants based on amphoteric compounds, primary, secondary and/or tertiary amines and/or salts of such amines having the general formula (I), (IIa), (IIb), (IIIa), (IIIb), (IIIc), (IVa) and (IVb)

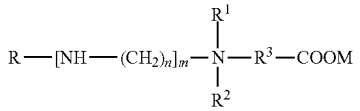

(I)

$R^4$—NH—$R^5$ (IIa)

$R^4$—$N^+H_2$—$R^5X^-$ (IIb)

$R^4$—NH—$(CH_2)_3NH_2$ (IIIa)

$R^4$—NH—$(CH_2)_3N^+H_3X^-$ (IIIb)

$R^4$—$N^+H_2$—$(CH_2)_3N^+H_32X^-$ (IIIc)

$R^4$—$NR^7R^8$ (IVa) and/or $R^4$—$N^+HR^7R^8X^-$ (IVb)

wherein

R represents a saturated or mono- or polyunsaturated, linear or branched alkyl residue with 6 to 22 C atoms, which can optionally be substituted by —OH, —$NH_2$, —NH—, —CO—, —$(CH_2CH_2O)_1$— or —$(CH_2CH_2CH_2O)_1$—, $R^1$ represents hydrogen, an alkyl residue with 1 to 4 C atoms, a hydroxyalkyl residue with 1 to 4 C atoms or an —$R^3$COOM residue $R^2$ only in the case where M represents a negative charge, represents hydrogen, an alkyl residue with 1 to 4 C atoms, or a hydroxyalkyl residue with 1 to 4 C atoms, $R^3$ represents a saturated or mono- or polyunsaturated, linear or branched alkyl residue with 1 to 12 C atoms, which can optionally be substituted by —OH, —$NH_2$, —NH—, —CO—, —$(CH_2CH_2O)_1$— or —$(CH_2CH_2CH_2O)_1$—, $R^4$ represents a substituted or unsubstituted, linear or branched, saturated or mono- or polyunsaturated alkyl residue with 6 to 22 C atoms, which can display as substituents at least one amine, imine, hydroxyl, halogen and/or carboxyl residue, a substituted or unsubstituted phenyl residue, which can display as substituents at least one amine, imine, hydroxyl, halogen, carboxyl and/or a linear or branched, saturated or mono- or polyunsaturated alkyl residue with 6 to 22 C atoms, $R^5$ represents hydrogen or—independently of $R^4$—an $R^4$ residue, X— represents an anion from the group of amidosulfonate, nitrate, halide, sulfate, hydrogen carbonate, carbonate, phosphate or $R^6$—COO—, wherein $R^6$ represents hydrogen, a substituted or unsubstituted, linear or branched alkyl residue with 1 to 20 C atoms or alkenyl residue with 2 to 20 C atoms, which can display as substituents at least one hydroxyl, amine or imine residue, or a substituted or unsubstituted phenyl residue, which can display as substituents an alkyl residue with 1 to 20 C atoms, and $R^7$ and $R^8$ independently represent a substituted or unsubstituted, linear or branched alkyl residue with 1 to 20 C atoms or alkenyl residue with 2 to 20 C atoms, which can display as substituents at least one hydroxyl, amine or imine residue, or a substituted or unsubstituted phenyl residue, which can display as substituents an alkyl residue with 1 to 20 C atoms, M represents hydrogen, alkali metal, ammonium, an alkyl residue with 1 to 4 C atoms, a benzyl residue or a negative charge, n represents an integer ranging from 1 to 12, m represents an integer ranging from 0 to 5, and l represents a number ranging from 0 to 5, containing alkyldimethylamine oxides and/or alkyloligoglycosides as nonionic surfactants.

EP-B-629 234 discloses a lubricant combination consisting of a) one or more compounds having the formula

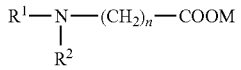

wherein $R^1$ represents a saturated or mono- or polyunsaturated, linear or branched alkyl residue with 6 to 22 C atoms, which can optionally be substituted by —OH, —$NH_2$, —NH—, —CO—, halogen or a carboxyl residue, $R^2$ represents a carboxyl residue with 2 to 7 C atoms, M represents hydrogen, alkali metal, ammonium, an alkyl residue with 1 to 4 C atoms or a benzyl residue and n represents an integer ranging from 1 to 6, b) at least one organic carboxylic acid selected from monobasic or polybasic, saturated or mono- or polyunsaturated carboxylic acids with 2 to 22 C atoms, c) optionally water and additives and/or auxiliary substances.

WO 94/03562 describes a lubricant concentrate based on fatty amines and optionally conventional diluting agents or additives or auxiliary substances, which concentrate is characterized in that it contains at least one polyamine derivative of a fatty amine and/or a salt of such an amine, the proportion of the above-mentioned polyamine derivatives of fatty amines in the overall formulation being 1 to 100 wt.-%.

According to a preferred embodiment of WO 94/03562, this lubricant concentrate contains at least one polyamine derivative of a fatty amine having the general formula $$\underset{(H^+X^-)_n}{R\text{-}A\text{-}(CH_2)_k}\text{—NH—}[(CH_2)_l\text{—NH}]_y\text{—}(CH_2)_m\text{—}NH_2.$$

wherein

R is a substituted or unsubstituted, linear or branched, saturated or mono- or polyunsaturated alkyl residue with 6 to 22 C atoms, the substituents being selected from amino, imino, hydroxyl, halogen and carboxyl, or a substituted or unsubstituted phenyl residue, the substituents being selected from amino, imino, hydroxyl, halogen, carboxyl and a linear or branched, saturated or mono- or polyunsaturated alkyl residue with 6 to 22 C atoms;

A represents either —NH— or —O—,

X— represents an anion of an inorganic or organic acid, k, l, m are independently an integer ranging from 1 to 6;

y is 0, 1, 2 or 3 if A=—NH— and 1, 2, 3 or 4 if A=—O—, n is an integer from 0 to 6.

Application DE 199 42 535.3 provides lubricants based on polyhydroxy compounds, which are hydrophilic because of their molecular structure and which at the same time improve the lubricating performance as compared with the amines conventionally used as lubricants.

Polyhydroxy compounds selected from alkanediols or alkanetriols are cited as being particularly preferred, most particularly preferably glycerol, or polymers thereof and their esters and ethers.

From the point of view of the user, however, the chain lubricants used still present the problem that they either adhere too poorly to the chains or attach too strongly to the chains.

Where chain lubricants adhere too poorly to the chains they drip onto the ground soon after application, with the result that the lubricating effect on the chains, which are several meters in length, is extremely dependent on the proximity to the metering point. The same problem occurs at places where there is a risk of the lubrication film rapidly being removed from the surface by spilled beverage. The consequence is that very different qualities of lubrication can occur from one section to another. In critical sections this commonly leads to bottles falling over and even to interruption of the filling operation.

Where chain lubricants adhere very well to the chains, as is the case with fluorosurfactants, for example, which have very good wetting properties, a firmly adhering film is formed on the conveyor chains, which cannot easily be removed by rinsing with water.

Residues and abraded material can accumulate in this film and lead to hygiene problems and breakdowns in operation.

The object of the present invention was accordingly to provide chain lubricants which on the one hand have good adhesion to the chains, display good lubricating properties and form a film that can easily be removed again from the chains if necessary. Such chain lubricants should also be available in a formulation stable in storage. Surprisingly, the above object can be achieved with O/W emulsions stable in storage.

Accordingly, the present invention is directed to the use of an O/W emulsion in concentrated form or after dilution with water for the lubrication of conveyor belts in food processing plants.

It is known that oil-in-water emulsions, hereinafter referred to as O/W emulsions, that are produced and stabilized with nonionic emulsifiers undergo phase inversion when heated. This process of phase inversion means that at elevated temperatures the outer, aqueous phase becomes the inner phase. This process is generally reversible, which means that the original emulsion type reforms again on cooling. It is also known that the phase inversion temperature point depends on many factors, for example the type and phase volume of the oil component, the hydrophilicity and structure of the emulsifier or the composition of the emulsifier system, cf. for example K. Shinoda and H. Kunieda in Encyclopedia of Emulsion Technology, Volume I, P. Becher (ed.), Marcel Decker, New York 1983, page 337 ff. It is also known that O/W emulsions produced at or slightly above the phase inversion temperature are particularly finely dispersed and are characterized by long-term stability. By contrast, emulsions produced below the phase inversion temperature are less finely dispersed, cf. S. Friberg, C. Solans, J. Colloid Interface Science 1978 [66], p. 367 f.

In "Progress in Colloid and Polymer Science" 1987 [73], p. 37, F. Schambil, F. Jost and M. J. Schwuger report on the properties of cosmetic emulsions containing fatty alcohols and fatty alcohol polyglycol ethers. They relate that emulsions that were produced above the phase inversion temperature display a low viscosity and high storage stability.

However, only emulsions whose oil phase consists entirely or predominantly of non-polar hydrocarbons were investigated in the cited publications. By contrast, corresponding emulsions whose oil component consists entirely or predominantly of polar esters or triglyceride oils behave differently: either (a) coarsely dispersed white emulsions are formed instead of finely dispersed blue emulsions in spite of a phase inversion or (b) no phase inversion at all occurs in the temperature range up to 100° C.

German patent application DE-OS-38 19 193 describes a process for the production of low-viscosity O/W emulsions of polar oil components, based on the phase inversion temperature method (PIT method). According to the teaching of this application, phase inversion temperatures below 100° C. are achieved by using additional co-emulsifiers together with nonionic emulsifiers. It was found, however, that only coarse dispersions are attainable with this method in the case of oils with a dipole moment above 1.96 D. This concurs with the publication by T. Förster, F. Schambil and H. Tesmann, who investigated emulsification by the PIT method with regard to self-emulsifying surfactants and the polarity of the oil to be emulsified (International Journal of Cosmetic Science 1990 [12], p. 217). On page 222 the authors state that the presence of a phase inversion is no guarantee that finely dispersed emulsions stable in storage are obtained.

WO 93/11865 presents an improved process for the production of finely dispersed O/W emulsions displaying long-term stability and based on oil mixtures with a high proportion of polar oil components. In particular, a process was provided by means of which finely dispersed O/W emulsions stable in storage and based on oils with a dipole moment above 1.96 D can be produced.

It was found that O/W emulsions based on polar oil materials and nonionic emulsifiers are particularly finely dispersed and stable over the long term if a mixture of polar oil, nonionic emulsifier and a special interfacial moderator are heated to a temperature within or above the phase inversion temperature range—or the emulsion is produced at this temperature—and then the emulsion is cooled to a temperature below the phase inversion temperature range and optionally further diluted with water.

Furthermore, WO 93/11865 claims a process for the production of oil-in-water emulsions of polar oil materials (A) in which (A) 10 to 90 wt.-% of a polar oil material is emulsified with (B) 0.5 to 30 wt.-% of a nonionic emulsifier with an HLB value of from 10 to 18 and (C) 0 to 30 wt.-% of a co-emulsifier from the group of fatty alcohols having 12 to 22 C atoms or partial esters of polyols having 3 to 6 C atoms with fatty acids having 12 to 22 C atoms and (D) 0.01 to 50 wt.-% of an interfacial moderator selected from the group of tocopherols, Guerbet alcohols with 16 to 20 C atoms or a steroid with 1 to 3 OH groups are emulsified in the presence of 8 to 85 wt.-% water at a temperature above the melting point of the mixture comprising components (A) to (D), and the emulsion is heated to a temperature within or above the phase inversion temperature range—or the emulsion is produced at this temperature—and the emulsion is then cooled to a temperature below the phase inversion temperature range and optionally further diluted with water.

This process has the advantage that particularly finely dispersed emulsions are obtained which display excellent storage stability. In comparison to the previously known prior art, e.g. DE-OS-38 19 193, the phase inversion temperature is also reduced, which is particularly favorable in practice because of the associated energy saving.

Oil-in-water emulsions produced by the PIT method are used for example as skin and body-care products, as cooling lubricants or as fiber and textile auxiliaries. They are particularly preferred in processes for the production of emulsion-type preparations for skin and hair treatment.

Reference is made in this connection to German patent DE 197 03 087 C2, from which is known the use of corresponding PIT emulsions for the production of cosmetic remoisturizing products.

In the currently available prior art a use according to the invention of O/W emulsions is neither disclosed nor referred to in any form.

In a preferred embodiment of the use according to the invention the O/W emulsion contains at least one wax ester.

The term wax esters refers to esters of long-chain carboxylic acids with long-chain alcohols, which preferably follow formula (1), $$R^1CO—OR^2 \quad (1)$$

wherein $R^1CO$ represents a saturated and/or unsaturated acyl residue with 6 to 22, preferably 12 to 18 carbon atoms, and $R^2$ represents an alkyl and/or alkenyl residue with 6 to 22, preferably 12 to 18 carbon atoms. Typical examples are esters of caproic acid, caprylic acid, 2-ethylhexanoic acid, capric acid, lauric acid, isotridecanoic acid, myristic acid, palmitic acid, palmitoleic acid, stearic acid, isostearic acid, oleic acid, elaidic acid, petroselinic acid, linoleic acid, linolenic acid, eleostearic acid, arachic acid, gadoleic acid, behenic acid and erucic acid and technical blends thereof with hexanol, octanol, 2-ethylhexanol, decanol, lauryl alcohol, isotridecyl alcohol, myristyl alcohol, cetyl alcohol, palmitoleyl alcohol, stearyl alcohol, isostearyl alcohol, oleyl alcohol, elaidyl alcohol, petroselinyl alcohol, linolyl alcohol, linolenyl alcohol, eleostearyl alcohol, arachyl alcohol, gadoleyl alcohol, behenyl alcohol, erucyl alcohol and brassidyl alcohol and technical blends thereof. Cetyl palmitate, cetyl stearate, cetyl isostearate, cetyl oleate, cetyl behenate, cetyl erucate, stearyl palmitate, stearyl stearate, stearyl isostearate, stearyl oleate, stearyl behenate, stearyl erucate, isostearyl palmitate, isostearyl stearate, isostearyl isostearate, isostearyl oleate, isostearyl behenate, isostearyl erucate, oleyl palmitate, oleyl stearate, oleyl isostearate, oleyl oleate, oleyl behenate, oleyl erucate, behenyl palmitate, behenyl stearate, behenyl isostearate, behenyl oleate, behenyl behenate, behenyl oleate and mixtures thereof are preferably used. Esters of the cited alcohols with fruit acids, i.e., malic, tartaric or citric acids, for example, fruit waxes and silicone waxes can also be used as wax esters.

The O/W emulsion for use according to the invention preferably contains at least one further component selected from the group of a) triglycerides b) partial glycerides, or c) fatty alcohol polyglycol ethers, or any mixture of the cited components a) to c).

The term triglycerides refers to substances having formula (2)

$$\begin{array}{l} CH_2O(CH_2CH_2O)mCOR^3 \\ | \\ CHO(CH_2CH_2O)nCOR^4 \\ | \\ CH_2O(CH_2CH_2O)pCOR^5 \end{array} \quad (2)$$

in which $R^3CO$, $R^4CO$ and $R^5CO$ independently represent linear or branched, saturated and/or unsaturated, optionally hydroxy- and/or epoxy-substituted acyl residues with 6 to 22, preferably 12 to 18 carbon atoms and the sum (m+n+p) represents 0 or numbers of from 1 to 100, preferably from 20 to 80. The triglycerides can be of natural origin or produced on a synthetic route. They are preferably hydroxy- and/or epoxy-functionalized substances, such as e.g. castor oil or hydrogenated castor oil, epoxidized castor oil, ring-opening products of epoxidized castor oils of varying epoxy values with water and addition products of on average 1 to 100, preferably 20 to 80 and particularly 40 to 60 mol to these cited triglycerides.

Partial glycerides are monoglycerides, diglycerides and technical blends thereof, which because of their manufacturing process can still contain small quantities of triglycerides. The partial glycerides preferably follow formula (3)

$$\begin{array}{l} CH_2O(CH_2CH_2O)mCOR^6 \\ | \\ CHO(CH_2CH_2O)nR^7 \\ | \\ CH_2O(CH_2CH_2O)pR^8 \end{array} \quad (3)$$

in which $R^6CO$ represents a linear or branched, saturated and/or unsaturated acyl residue with 6 to 22, preferably 12 to 18 carbon atoms, $R^7$ and $R^8$ independently represent $R^6CO$ or OH and the sum (m+n+p) stands for 0 or numbers from 1 to 100, preferably 5 to 25, with the proviso that at least one of the two residues $R^7$ and $R^8$ represents OH. Typical examples are monoglycerides and/or diglycerides based on caproic acid, caprylic acid, 2-ethylhexanoic acid, capric acid, lauric acid, isotridecanoic acid, myristic acid, palmitic acid, palmitoleic acid, stearic acid, isostearic acid, oleic acid, elaidic acid, petroselinic acid, linoleic acid, linolenic acid, eleostearic acid, arachic acid, gadoleic acid, behenic acid and erucic acid and technical blends thereof. Technical lauric acid glycerides, palmitic acid glycerides, stearic acid glycerides, isostearic acid glycerides, oleic acid glycerides, behenic acid glycerides and/or erucic acid glycerides are preferably used which display a monoglyceride content in the range from 50 to 95, preferably 60 to 90 wt.-%.

The fatty alcohol polyglycol ethers of relevance to the invention correspond to formula (4), $$R^9O(CH_2CH_2O)qH \quad (4)$$

in which $R^9$ represents a linear or branched alkyl and/or alkenyl residue with 6 to 22 carbon atoms and q stands for numbers from 1 to 50. Typical examples are addition products of on average 1 to 50, preferably 5 to 25, to hexanol, octanol, 2-ethylhexanol, decanol, lauryl alcohol, isotridecyl alcohol, myristyl alcohol, cetyl alcohol, palmitoleyl alcohol, stearyl alcohol, isostearyl alcohol, oleyl alcohol, elaidyl alcohol, petroselinyl alcohol, linolyl alcohol, linolenyl alcohol, eleostearyl alcohol, arachyl alcohol, gadoleyl alcohol, behenyl alcohol, erucyl alcohol and brassidyl alcohol and technical blends thereof. The surfactants can exhibit both a conventionally broad and a narrow homologue distribution. Addition products of on average 10 to 20 mol ethylene oxide to cetearyl alcohol, stearyl alcohol and/or behenyl alcohol are particularly preferred.

Examples of other components include co-emulsifiers such as non-ionogenic surfactants from at least one of the following groups:

(1) addition products of 2 to 30 mol ethylene oxide and/or 0 to 5 mol propylene oxide to linear fatty alcohols with 8 to 22 C atoms, to fatty acids with 12 to 22 C atoms and to alkylphenols with 8 to 15 C atoms in the alkyl group;

(2) glycerol monoesters and diesters and sorbitan monoesters and diesters of saturated and unsaturated fatty acids with 6 to 22 carbon atoms and ethylene oxide addition products thereof;

(3) alkylmono- and -oligoglycosides with 8 to 22 carbon atoms in the alkyl residue and ethoxylated analogs thereof;

(4) polyol esters and in particular polyglycerol esters such as polyglycerol polyricinoleate or polyglycerol poly-12-hydroxystearate; also suitable are mixtures of compounds from several of these classes of substances;

(5) partial esters based on linear, branched, unsaturated or saturated C6/22 fatty acids, ricinoleic acid and 12-hydroxystearic acid and glycerol, polyglycerol, pentaerythritol, dipentaerythritol, sugar alcohols (e.g. sorbitol), alkylglucosides (e.g. methylglucoside, butylglucoside, laurylglucoside) and polyglucosides (e.g. cellulose);

(6) trialkyl phosphates and mono-, di- and/or tri-PEG alkyl phosphates;

(7) wool wax alcohols;

(8) polysiloxane-polyalkyl-polyether copolymers or corresponding derivatives;

(9) mixed esters of pentaerythritol, fatty acids, citric acid and fatty alcohol according to DE-PS 1165574 and/or mixed esters of fatty acids with 6 to 22 carbon atoms, methylglucose and polyols, preferably glycerol, and

(13) polyalkylene glycols.

The addition products of ethylene oxide and/or propylene oxide to fatty alcohols, fatty acids, alkylphenols, glycerol monoesters and diesters and sorbitan monoesters and diesters of fatty acids or to castor oil are well-known, commercially available products. They are mixtures of homologues whose average degree of alkoxylation corresponds to the ratio of the amounts of ethylene oxide and/or propylene oxide and substrate with which the addition reaction is performed.

C8/18 alkylmonoglycosides and -oligoglycosides, their production and their use as surface-active substances are known for example from U.S. Pat. No. 3,839,318, U.S. Pat. No. 3,707,535, U.S. Pat. No. 3,547,828, DE-OS 19 43 689, DE-OS 20 36 472 and DE-A-130 01 064 and EP-A-0 077 167. They are produced in particular by reacting glucose or oligosaccharides with primary alcohols having 8 to 18 C atoms. With regard to the glycoside residue, both monoglycosides in which a cyclic sugar residue is glycosidically bound to the fatty alcohol and oligomeric glycosides with a degree of oligomerization of up to preferably around 8 are suitable. The degree of oligomerization is a statistical average based on the homologue distribution as common in technical products of that type.

Zwitterionic surfactants can also be used as emulsifiers. The term zwitterionic surfactants comprises surface-active compounds carrying at least one quaternary ammonium group and at least one carboxylate group and a sulfonate group in the molecule. Particularly suitable zwitterionic surfactants are the so-called betaines such as N-alkyl-N,N-dimethylammonium glycinates, for example coconut-alkyldimethylammonium glycinate, N-acylaminopropyl-N,N-dimethylammonium glycinates, for example coconut-acylaminopropyldimethylammonium glycinate, and 2-alkyl-3-carboxymethyl-3-hydroxyethylimidazolines, each having 8 to 18 C atoms in the alkyl or acyl group, and coconut-acylaminoethyl-hydroxyethyl-carboxymethyl glycinate. The fatty acid amide derivative know under the CTFA designation cocamidopropylbetaine is particularly preferred. Other suitable emulsifiers are ampholytic surfactants. Ampholytic surfactants are understood to be surface-active compounds that in addition to a C8/18 alkyl or acyl group in the molecule also contain at least one free amino group and at least one —COOH or —SO3H group and are capable of forming internal salts. Examples of suitable ampholytic surfactants are N-alkylglycines, N-alkylpropionic acids, N-alkylaminobutyric acids, N-alkyliminodipropionic acids, N-hydroxyethyl-N-alkylamidopropylglycines, N-alkyltaurines, N-alkylsarcosines, 2-alkylaminopropionic acids and alkylaminoacetic acids, each having around 8 to 18 C atoms in the alkyl group. Particularly preferred ampholytic surfactants are N-coconut-alkylaminopropionate, coconut-acylaminoethylaminopropionate and C12/18 acylsarcosine. Also suitable in addition to ampholytic emulsifiers are quaternary emulsifiers, and those of the esterquat type, preferably methyl-quaternized difatty acid triethanolamine ester salts, are particularly preferred.

Substances such as e.g. lanolin and lecithin and polyethoxylated or acylated lanolin and lecithin derivatives, polyol fatty acid esters, monoglycerides and fatty acid alkanolamides can be used as further additives, the latter simultaneously serving as foam stabilizers. Suitable examples of consistency modifiers, where required, are primarily fatty alcohols with 12 to 22 and preferably 16 to 18 carbon atoms, as well as partial glycerides. A combination of these substances with alkyloligoglucosides and/or fatty acid N-methylglucamides of the same chain length and/or polyglycerol poly-12-hydroxystearates is preferred. Suitable thickening agents, where required, are for example polysaccharides, in particular xanthan gum, guar-guar, agar-agar, alginates and tyloses, carboxymethylcellulose and hydroxyethylcellulose, as well as higher-molecular weight polyethylene glycol mono- and diesters of fatty acids, polyacrylates (e.g. Carbopole® from Goodrich or Synthalene® from Sigma), polyacrylamides, polyvinyl alcohol and polyvinylpyrrolidone, surfactants such as ethoxylated fatty acid glycerides, esters of fatty acids with polyols such as pentaerythritol or trimethylolpropane, fatty alcohol ethoxylates with narrow homologue distribution or alkyloligoglucosides and electrolytes such as common salt and ammonium chloride.

Depending on the properties required of the O/W emulsion for use according to the invention, suitable cationic polymers can also be added. These are selected for example from cationic cellulose derivatives, such as e.g. quaternized hydroxyethylcellulose, which is available from Amerchol under the name Polymer JR 400®, cationic starch, copolymers of diallylammonium salts and acrylamides, quaternized vinylpyrrolidone/vinylimidazole polymers such as Luviquat® (BASF), condensation products of polyglycols and amines, quaternized collagen polypeptides such as lauryldimonium hydroxypropyl hydrolyzed collagen (Lamequat® L/Grünau), quaternized wheat polypeptides, polyethyleneimine, cationic silicone polymers such as amidomethicones, copolymers of adipic acid and dimethylaminohydroxypropyldiethylenetriamine (Cartaretine®/Sandoz), copolymers of acrylic acid with dimethyldiallylammonium chloride (Merquat® 550/Chemviron), polyaminopolyamides such as described e.g. in FR-A 22 52 840 and crosslinked water-soluble polymers thereof, cationic chitin derivatives such as e.g. quaternized chitosan, optionally with microcrystalline distribution, condensation products of dihaloalkyls such as e.g. dibromobutane with bisdialkylamines such as bis-dimethylamino-1,3-propane, cationic guar gum such as Jaguar® CBS, Jaguar® C-17, Jaguar® C-16 from Celanese, quaternized ammonium salt polymers such as Mirapol®A-15, Mirapol® AD-1, Mirapol® AZ-1 from Miranol.

Hydrotropes such as ethanol, isopropyl alcohol or polyols can also be used to improve the flow properties of the O/W emulsion for use according to the invention. Suitable polyols for this purpose preferably have 2 to 15 carbon atoms and at least two hydroxyl groups. Typical examples are glycerol;

alkylene glycols such as e.g. ethylene glycol, diethylene glycol, propylene glycol, butylene glycol, hexylene glycol and polyethylene glycols with an average molecular weight of 100 to 1000 daltons;

technical oligoglycerol blends with an intrinsic degree of condensation of 1.5 to 10, such as technical diglycerol blends with a diglycerol content of 40 to 50 wt.-%;

methylol compounds, such as in particular trimethylolethane, trimethylolpropane, trimethylolbutane, pentaerythritol and dipentaerythritol;

lower-alkylglucosides, in particular those having 1 to 8 carbon atoms in the alkyl residue, such as methyl- and butylglucoside;

sugar alcohols having 5 to 12 carbon atoms, such as sorbitol or mannitol, sugars having 5 to 12 carbon atoms, such as glucose or sucrose;

amino sugars such as glutamine.

In a preferred embodiment of the present invention O/W emulsions containing (x) 1 to 50 wt.-% wax esters, (a) 0.04 to 10 wt.-% triglycerides, (b) 0.04 to 10 wt.-% partial glycerides and (c) 0.04 to 20 wt.-% fatty alcohol polyglycol ethers are used, with the proviso that the cited quantities are supplemented with water and optionally further conventional additives and auxiliary substances so as to make 100 wt.-%.

The O/W emulsions for use according to the invention preferably contain at least one alcoholic component selected from monohydroxy, dihydroxy and trihydroxy compounds, in combination with at least one further component selected from d) nitrogen-containing, aliphatic, organic compounds with less than 10 C atoms in the molecule, preferably less than 7 C atoms in the molecule, which particularly preferably contains an additional OH group, and/or e) an organic carboxylic acid with 1 to 10 C atoms in the molecule, preferably acetic acid and/or caproic acid.

Furthermore, the proportion of the cited alcoholic component, relative to the overall O/W emulsion for use according to the invention, is preferably greater than 20 wt.-%, particularly preferably greater than 50 wt.-%, but no greater than 61.8 wt.-%.

The cited alcoholic component to be used in the O/W emulsion for use according to the invention is preferably substantially glycerol.

Also regarded as being preferred is an O/W emulsion for use according to the invention containing as the cited nitrogen-containing compound (d) a compound having formula (5)

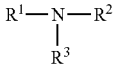

(5)

wherein the residues $R^1$, $R^2$, $R^3$ can independently be H or —$(CH_2)_n$—OH with n=1 or 2 and not all residues $R^1$, $R^2$, $R^3$ can simultaneously be H. The cited nitrogen-containing compound (d) is most particularly preferably monoethanolamine and/or triethanolamine.

Where the cited nitrogen-containing compound (d) is present in the O/W emulsion for use according to the invention, its proportion relative to the overall concentrate is 0.1 to 20 wt.-%.

Where the cited organic carboxylic acid (e) is present in the O/W emulsion for use according to the invention, its proportion relative to the overall concentrate is 0.1 to 20 wt.-%.

Furthermore, the proportion of the aqueous phase in the O/W emulsion for use according to the invention is preferably greater than 95 wt.-%, relative to the entire O/W emulsion. In the sense of the present invention the term aqueous phase refers to at least 10 wt.-% water together with all components contained within it, with the proviso that together they form a single phase, with no phase boundaries.

In another O/W emulsion for use according to the invention this is in the form of a high concentrate containing (x) 25 to 50 wt.-% wax esters, (a) 1 to 10 wt.-% triglycerides, (b) 1 to 10 wt.-% partial glycerides, and (c) 1 to 20 wt.-% fatty alcohol polyglycol ethers, with the proviso that the cited quantities are supplemented with water and optionally further conventional additives and auxiliary substances so as to make 100 wt.-%.

Depending on the formulation, the O/W emulsion for use according to the invention also preferably contains at least one antimicrobial component selected from the groups of alcohols, aldehydes, antimicrobial acids, carboxylic esters, amides, phenols, phenol derivatives, diphenyls, diphenylalkanes, urea derivatives, oxygen acetals and formals, nitrogen acetals and formals, benzamidines, isothiazolines, phthalimide derivatives, pyridine derivatives, antimicrobial surface-active compounds, guanidines, antimicrobial amphoteric compounds, quinolines, 1,2-dibromo-2,4-dicyanobutane, iodo-2-propynylbutylcarbamate, iodine, iodophors, peroxides, peracids, the cited components being different from the components in the O/W emulsion for use according to the invention that have already been mentioned.

Furthermore, in a preferred embodiment the O/W emulsion for use according to the invention is produced immediately before it is applied to the belts on the cited conveyor belt system, and in a particularly preferred fashion the cited O/W emulsion is produced in special mixing nozzles that are suitable for the production of O/W emulsions.

The O/W emulsion or the diluted solution thereof for use according to the invention is preferably used for the transport of plastic, cardboard, metal or glass containers, and in the case of plastic containers, these particularly preferably contain at least one polymer selected from the groups of polyethylene terephthalates (PET), polyethylene naphthenates (PEN), polycarbonates (PC), PVC and are most particularly preferably PET drinks bottles.

Furthermore, when using the O/W emulsion for use according to the invention, additional antimicrobial agents, in particular organic peracids, chlorine dioxide or ozone, are preferably used separately during the application.

In the application of the O/W emulsion for use according to the invention, the O/W emulsion is further preferably applied directly to the belts on the conveyor system by means of an application device, without prior dilution.

In the application of the O/W emulsion for use according to the invention, the O/W emulsion is likewise preferably diluted with water in the conveyor system, particularly preferably by a dilution factor between 20,000 and 100, before it is applied to the belts on the conveyor system by means of an application device.

In another preferred embodiment of the application of the O/W emulsion for use according to the invention, the application device is preferably in direct contact with the surfaces to be lubricated during the application. In the sense of the present invention this means that the application is performed for example using a paintbrush, sponge, rags, wipers, that are in direct contact with the chain.

Depending on requirements, a spray device can also preferably be used as the application device.

The invention is also directed to a lubricant concentrate in the form of an O/W emulsion and containing a wax ester, for the lubrication of conveyor belt systems in food processing plants.

The lubricant concentrate according to the invention preferably contains at least one further component selected from the groups of a) triglycerides, b) partial glycerides, or c) fatty alcohol polyglycol ethers.

All explanations given in connection with the description of the O/W emulsion for use according to the invention also apply in the same way to the lubricant concentrates according to the invention.

EXAMPLES

Chain lubricant concentrates were formulated as an O/W emulsion in various compositions and investigated for their properties. The viscosity of the preparations E1 and E2 was measured by the Brookfield method in an RVF viscometer (spindle 1, 10 revolutions per minute (rpm)), once immediately after production (20° C.) and again after a storage period of 4 weeks at 45° C. The stability of the formulations was determined visually after storage (4 w, 45° C.), where "+" denotes stable and "–" phase separation.

TABLE 1

Formulations of the tested chain lubricants (quantities in wt.-%)

| Composition/property | E1 | E2 | E3 | E4 | E5 | E6 | E7 | E8 | E9 |
|---|---|---|---|---|---|---|---|---|---|
| Cetyl palmitate | 30 | 40 | 4.44 | 2.678 | 2.08 | 3.33 | 3.33 | 4.44 | 4.44 |
| Hydrogenated castor oil | 4 | 6 | 0.67 | 0.4 | 0.26 | 0.44 | 0.44 | 0.67 | 0.67 |
| Glyceryl stearate | 2 | 3 | 0.33 | 0.2 | 0.13 | 0.22 | 0.22 | 0.33 | 0.33 |
| Beheneth-10 (behenyl alcohol/$C_{22}$ with approx. 10 mol EO) | 8 | 12 | 1.33 | 0.8 | 0.52 | 0.89 | 0.89 | 1.33 | 1.33 |
| Formic acid | — | — | 2 | — | 0.13 | — | — | — | — |
| Acetic acid | — | — | — | 3 | — | — | — | — | — |
| $C_{18}$ Alkoxypropylamine | — | — | — | 5 | — | — | — | — | — |
| KOH | — | — | — | 2 | — | — | — | — | — |
| Tallow betaine | — | — | — | — | 10 | — | — | — | — |
| Peracetic acid | — | — | — | — | — | 2 | — | — | — |
| Benzalkonium chloride | — | — | — | — | — | — | 10 | — | — |
| Monobromoacetic acid | — | — | — | — | — | — | — | 12.5 | — |
| Iodine | — | — | — | — | — | — | — | — | 1.1 |
| Potassium iodide | — | — | — | — | — | — | — | — | 2 |
| Water | to make 100 wt.-% | | | | | | | | |
| Viscosity - immediate [mPa□s] | 6000 | 6400 | — | — | — | — | | — | — |
| Viscosity - after storage [mPa□s] | 6100 | 6400 | — | — | — | — | | — | — |
| Stability | + | + | – | – | – | – | | – | – |

Lubrication tests were performed with formulations E1 and E3, as well as E4. For this purpose the product was diluted with water of varying qualities in order to determine any dependency of lubricating performance on water quality. PET bottles were used as transport containers in lubrication tests on test conveyors. The tests were conducted in a way as described in the prior art.

The PET bottles were also tested on various chain materials.

Very good lubrication values were obtained as is show in Table 2 below.

In the case of saline, hard water in particular, the formulation E1 displays outstanding lubrication values. The formulations E3 and E4 show excellent values with completely desalted water as well.

Similar properties were achieved in tests with the other formulations E2, as well as E5 through E9.

TABLE 2

Lubrication tests with diluted working solutions of formulations E1, and E3 as well as E4

| Formulation | Chain material | Concentration [ppm] | Water | Coefficient of friction |
|---|---|---|---|---|
| E1 | Steel | 100 | CD (completely desalted) | 0.110-0.140 |
| | | 100 | 16°d | 0.060-0.080 |
| | | 200 | CD (completely desalted) | 0.100-0.120 |
| | | 200 | 16°d | 0.065-0.090 |
| | | 400 | CD (completely desalted) | 0.070-0.080 |
| | | 400 | 16°d | 0.045-0.060 |
| | Plastic | 100 | CD (completely desalted) | 0.120-0.160 |
| | | 100 | 16°d | 0.075-0.090 |
| | | 200 | CD (completely desalted) | 0.080-0.130 |
| | | 200 | 16°d | 0.055-0.080 |
| | | 400 | CD (completely desalted) | 0.070-0.110 |

TABLE 2-continued

Lubrication tests with diluted working solutions of formulations E1, and E3 as well as E4

| Formulation | Chain material | Concentration [ppm] | Water | Coefficient of friction |
|---|---|---|---|---|
| | | 400 | 16°d | 0.050-0.070 |
| E3 | Steel | 1000 | CD (completely desalted) | 0.07-0.09 |
| | | 1000 | 16°d | 0.06-0.08 |
| | Plastic | 1000 | CD (completely desalted) | 0.065-0.08 |
| | | 1000 | 16°d | 0.05-0.07 |
| E4 | Steel | 700 | CD (completely desalted) | 0.065-0.09 |
| | | 700 | 16°d | 0.055-0.07 |
| | Plastic | 700 | CD (completely desalted) | 0.05-0.07 |
| | | 700 | 16°d | 0.04-0.06 |

°d = German hardness

When evaluating the above test series, it should be noted, among other things, that combinations including alkoxypropylamine achieve outstanding lubrication values despite lower amount of cetyl palmitate active substance in such combinations. Another advantage in such combinations is that alkoxypropyleneamines contribute additional antimicrobial activity to the combination.

These advantages were confirmed in several tests for the alkoxypropylamine types that are well-known in chain lubricants and have the general formula $$R\text{-}A\text{-}(CH_2)k\text{—}NH\text{—}[(CH_2)l\text{—}NH]y\text{—}H.(H+X\text{—})n \quad (V)$$

wherein

R is a substituted or unsubstituted, linear or branched, saturated or mono- or polyunsaturated alkyl residue with 6 to 22 C atoms, the substituents being selected from amino, imino, hydroxyl, halogen and carboxyl, or a substituted or unsubstituted phenyl residue, the substituents being selected from amino, imino, hydroxyl, halogen, carboxyl and a linear or branched, saturated or mono- or polyunsaturated alkyl residue with 6 to 22 C atoms;

A represents —O—,

X— represents an anion of an inorganic or organic acid, k, l are independently an integer ranging from 1 to 6;

y is 0, 1, 2, 3, 4 or 5, n is an integer from 0 to 6.

Also, very good lubrication values were achieved by combining the inventive lubricant concentrates with amines of formula (V) wherein A represents an —NH— group.

Moreover, good results are obtained when combining the lubricant concentrates of the invention with chain lubricating agents according to the formulas (I), (IIa), (IIb), (IIIa), (IIIb), (IIIc), (IVa) and/or (IVb) that are well-known from the literature and practice.

In such combinations, the otherwise required active substance concentration of amines frequently regarded as critical from a toxicological and ecological point of view can be reduced at will.

Accordingly, the present invention also widens the spectrum of formulation resources to the applications engineer.

In general, the lubricant concentrates combined with amine-containing chain lubricant active substances have sufficiently good antimicrobial activity to prevent germ growth or even destroy germs in practice. In those cases where these combination active substances are absent or their concentration is not sufficiently high, it is of course possible to add further antimicrobially active substances.

This is illustrated in the Examples E6, E7, E8 and E9 merely by way of example. In addition, there are many other options.

The TNO method was performed to determine the material compatibility. To this end, formulation E1 was used without dilution and as a working solution with 1% dilution.

According to the description of the test, PET bottles are filled with water and conditioned with carbon dioxide in such a way that the pressure inside the bottles is approximately 7 bar. The base cups of the bottles are then dipped in the formulation of the comparative example or the example for use according to the invention and stored in a Petri dish for a period of 24 hours. After 24 hours the bottles are opened, emptied and the base cups rinsed with water. A visual evaluation of the base cups reveals that in the test with the example for use according to the invention only a few shallow stress cracks, grade A, are present in the base area. Grading is performed in accordance with the reference pictures contained in chapter IV-22 of the book "CODE OF PRACTICE—Guidelines for an Industrial Code of Practice for Refillable PET Bottles", Edition 1, 1993-1994.

Accordingly, the performance in respect of PET bottles can likewise be rated as positive: little stress corrosion cracking, confined to the base cup, was determined for both tests. The stand ring displayed no stress corrosion cracking.

As already indicated, it was found that the persistence of the working solution of agent E1 according to the invention on the chains increases as the water hardness increases.

An increase in the water hardness can accordingly also extend the intervals between metering times.

What is claimed is:

1. A method of lubricating a container conveyor comprising:

applying an emulsion to a portion of the conveyor or a portion of the container, wherein the emulsion comprises (a) a compound of the following formula:

$$R^1CO\text{—}OR^2$$

wherein $R^1CO$ is a saturated or unsaturated acyl residue with 4 to 22 carbon atoms, and $R^2$ is a linear or branched alkyl or alkenyl residue with 6 to 22 carbon atoms; and (b) one or more fatty alcohol polyglycol ethers.

2. The method of claim 1, wherein the emulsion further comprises polysiloxane-polyalkyl-polyether copolymers.

3. The method of claim 1, wherein the emulsion further comprises an alcohol component selected from the group consisting of monohydroxy, dihydroxy, and trihydroxy compounds.

4. The method of claim 1, wherein immediately prior to applying the emulsion, the emulsion is produced in mixing nozzles.

5. The method of claim 1, wherein the emulsion is produced by a phase-inversion-temperature method.

6. The method of claim 1, wherein the emulsion comprises 95 wt-% or more of an aqueous phase.

7. The method of claim 1, wherein the emulsion comprises from 1 to 50 wt-% of compound $R^1CO\text{—}OR^2$ and 0.04 to 20 wt-% of fatty alcohol polyglycol ethers.

8. The method of claim 1, wherein the emulsion is a concentrate comprising from 25 to 50 wt-% of compound $R^1CO\text{—}OR^2$ and 1 to 20 wt-% of fatty alcohol polyglycol ethers.

9. The method of claim 8, wherein prior to applying the emulsion, the emulsion is diluted with water by a dilution factor between 20,000 and 100.

10. A container conveyor lubricant composition comprising an emulsion, wherein the emulsion comprises:

(a) a compound of the following formula:

$$R^1CO\text{—}OR^2$$

wherein $R^1CO$ is a saturated or unsaturated acyl residue with 4 to 22 carbon atoms, and $R^2$ is a linear or branched alkyl or alkenyl residue with 6 to 22 carbon atoms;

(b) one or more fatty alcohol polyglycol ethers; and (c) one or more polysiloxane-polyalkyl-polyether copolymers.

11. The container conveyor lubricant composition of claim 10 further comprising an alcohol component selected from the group consisting of monohydroxy, dihydroxy, and trihydroxy compounds.

12. The container conveyor lubricant composition of claim 10, wherein the composition comprises from 1 to 50 wt-% of compound $R^1CO\text{—}OR^2$ and 0.04 to 20 wt-% of fatty alcohol polyglycol ethers.

13. The container conveyor lubricant composition of claim 10, wherein the one or more fatty alcohol polyglycol ethers correspond to the following formula:

$$R^3O(CH_2CH_2O)_nH,$$

wherein $R^3$ represents a linear or branched alkyl and/or alkenyl residue with 6 to 22 carbon atoms and n is a number from 1 to 50.

14. The container conveyor lubricant composition of claim 10, wherein the emulsion is essentially free of triglycerides and partial glycerides.

15. The method of claim 1, wherein $R^1CO$ is a saturated or unsaturated acyl residue with 12 to 28 carbon atoms.

16. The method of claim 15, wherein $R^1CO$ is a saturated or unsaturated acyl residue with 18 carbon atoms.

17. The method of claim 1, wherein the one or more fatty alcohol polyglycol ethers comprise an addition product of ethylene oxide and a linear or branched alkyl residue with 6 to 22 carbon atoms.

18. The method of claim 1, wherein the emulsion further comprises a polyalkylene glycol.

19. The method of claim 1, wherein the emulsion further comprises a polysaccharide.

* * * * *